US010704784B2

(12) United States Patent
Rååd

(10) Patent No.: US 10,704,784 B2
(45) Date of Patent: Jul. 7, 2020

(54) ATTEMPERATOR AND A USE OF A SUCH

(71) Applicant: CCI VALVE TECHNOLOGY AB, Saffle (SE)

(72) Inventor: Pontus Rååd, Saffle (SE)

( * ) Notice: Subject to any disclaimer, the term of this patent is extended or adjusted under 35 U.S.C. 154(b) by 0 days.

(21) Appl. No.: 16/472,310

(22) PCT Filed: Dec. 22, 2017

(86) PCT No.: PCT/SE2017/051344
§ 371 (c)(1),
(2) Date: Jun. 21, 2019

(87) PCT Pub. No.: WO2018/117957
PCT Pub. Date: Jun. 28, 2018

(65) Prior Publication Data

US 2019/0376683 A1 Dec. 12, 2019

(30) Foreign Application Priority Data

Dec. 22, 2016 (SE) ..... 1651726

(51) Int. Cl.
*F22G 5/12* (2006.01)
*B01F 3/04* (2006.01)
*F28C 3/08* (2006.01)

(52) U.S. Cl.
CPC ..... *F22G 5/12* (2013.01); *B01F 3/04* (2013.01); *F28C 3/08* (2013.01); *F28F 2265/10* (2013.01); *F28F 2275/08* (2013.01)

(58) Field of Classification Search
CPC ..... B01F 3/04; F22G 5/12
(Continued)

(56) References Cited

U.S. PATENT DOCUMENTS 2,421,761 A * 6/1947 Rowand ..... F22G 5/12 261/116
2009/0065295 A1 3/2009 Sherikar
2014/0151908 A1 1/2014 Forslund

FOREIGN PATENT DOCUMENTS

GB 656551 A 8/1951
WO 2015088541 A1 6/2015

OTHER PUBLICATIONS

PCT Request, PCT/SE17/51344.
Written Opinion of the International Search Authority PCT/SE17/51344.

* cited by examiner

*Primary Examiner* — Robert A Hopkins
(74) *Attorney, Agent, or Firm* — Ostrolenk Faber LLP

(57) ABSTRACT

The invention relates ton attemperator. It has a pipe section (3) and a liner pipe section (4) arranged within the pipe section (3) and being attached thereto. The pipe section (3) has an internal wall surface (33) and the liner pipe section (4) has an external wall surface (43). The internal wall surface (33) and external wall surface (43) form a gap (6) between them. The pipe section (3) and liner pipe section (4) each has an inlet end (31, 41) for connection to a steam supply and an outlet end (32, 42) for steam. The attemperator is provided with water injection means (2) arranged for supplying water into the interior of the liner pipe section (4). The inlet end (31) of the liner pipe section (3) has an outwardly extending wall portion (44) forming an outer circumferential outer zone (45), which zone (45) may contact the internal wall surface (33) of the pipe section (3). According to the invention there is provided a plurality of openings (47) arranged to allow steam to enter the space formed by the gap (6) between the internal wall surface (33) and the external wall surface (43).
The invention also relates to a use of the attemperator.

16 Claims, 3 Drawing Sheets

(58) Field of Classification Search
USPC ..... 261/116
See application file for complete search history.

ATTEMPERATOR AND A USE OF A SUCH

CROSS-REFERENCE TO RELATED APPLICATIONS

This application is the U.S. National Stage of PCT application No. PCT/SE2017/051344, filed Dec. 22, 2017, which claims priority to Swedish Patent Application No. 1651726-0, filed on Dec. 22, 2016.

FIELD OF INVENTION

The present invention relates to an attemperator including a pipe section and a liner pipe section arranged within the pipe section and being attached thereto, the pipe section having an internal wall surface and the liner pipe section having an external wall surface, which internal wall surface and external wall surface form a gap between them along at least a major part of the axial extension of the liner pipe section, which pipe section and liner pipe section each has an inlet end for connection to a steam supply and an outlet end for steam, and which attemperator is provided with water injection means arranged for supplying water into the interior of the liner pipe section, the inlet end of the liner pipe having an outwardly extending wall portion forming an outer circumferential contact zone, which zone contacts the internal wall surface of the pipe section.

According to a second aspect of the invention it relates to a use of the invented attemperator.

The pipe section and the liner pipe section on which the water injection means is arranged thus in this application is considered as a part of the attemperator.

In this application terms like "axial" and "circumferential" are related to the axial extension of the pipe section if not explicitly mentioned otherwise. Normally the pipe section has circular shape in which the circumferential is a circle. However other possible shapes such as elliptic are not excluded.

BACKGROUND OF INVENTION

In steam driven power plants usually superheated steam is used to run the turbines. In order to avoid damage to the turbine or to overheat the same, it might be important to control the temperature of the supplied steam. The development in this field goes toward higher temperatures of the supplied superheated steam. This increases the demand on the equipment, which also includes the attemperator.

An attemperator is in this context used to lower the temperature of the superheated steam. The attemperator sprays cooling water into the flow of the superheated steam in the supply pipe. When mixing with the steam the water evaporates and thereby takes thermal energy from the steam such that it will be cooled. The water is injected into the steam supply pipe at a section that is provided internally with a lining pipe.

The purpose of the lining pipe section is to protect the steam pipe section from the high temperature of the superheated steam in the region where the water is injected.

Since the temperature of the superheated steam may be very high, such as above 600° C., the temperature difference between the water and the steam will be very high imposing stresses to the steam pipe section.

A representative example of an attemperator is disclosed in U.S. Pat. No. 9,038,993, which describes an attemperator corresponding to the preamble of claim 1 in the present application. Other examples of attemperators are disclosed in U.S. Pat. Nos. 2,421,761, 4,421,069 and CN 102748747.

SUMMARY OF INVENTION

A severe problem according to conventional technique, e.g. as represented by U.S. Pat. No. 9,038,993 is the fact that the temperature difference between the liner tube section, being exposed to the superheated steam and the outer tube section will be very high. This temperature difference may be a threat to a proper mounting of the liner pipe section in the outer pipe section and to the mounting of the water injection means.

The object of the present invention is to overcome this problem and thus eliminate or at least reduced the risk for failure due to a too high temperature difference between the pipe section and the liner pipe section.

According to the present invention this problem is solved in that an attemperator of the kind specified in the preamble of claim 1 includes the specific features specified in the characterizing portion of the claim. Thus, there is provided at least one opening at the inlet end of the liner pipe section arranged to allow steam to enter the space formed by the gap between said internal wall surface and said external wall surface.

The opening(s) will open up communication between the inflowing steam and the space between the liner pipe section and the pipe section. A fraction of the inflowing steam thereby will flow through the opening(s) and come into contact with the internal wall of the pipe section. The temperature of the pipe section thereby will increase, and the temperature difference in relation to the liner pipe section consequently will decrease. This will reduce the risk for damages of the kind mentioned above, and possibly eliminate this risk if the opening(s) is/are tuned properly with regards to the size of the fraction of steam flowing therethrough. Since anyhow only a fraction of the steam will enter into the space between the pipe section and the liner pipe section, the heating of the pipe section will be moderate and not lead to the risk of overheating this.

According to a preferred embodiment of the invented attemperator, the at least one opening is a plurality of openings.

With a plurality of openings the heating of the pipe section will be more uniform and better controlled. Preferably the number of openings is four.

According to a further preferred embodiment, the openings are evenly distributed in the circumferential direction.

The even distribution of the openings will further contribute to a uniform heating.

According to a further preferred embodiment, each opening is formed between the internal wall surface of the pipe section and a recess in said contact zone.

Although the opening could be made as recesses in the internal wall of the tube section or as borings through the wall section, this embodiment has manufacturing advantages since the machining will be simpler.

According to a further preferred embodiment, the total circumferential extension of the opening(s) is in the range of 5 to 20% of the circumferential length of the contact zone.

For obtaining an adequate amount of steam flow into the gap and a uniform heating this range normally will be appropriate.

According to a further preferred embodiment, the total through flow area of the opening(s) is in the range of 1 to 10% of the total cross area of the space between the pipe section and the liner pipe section in a section perpendicular to the axial extension of the pipe section.

Also this embodiment represents an optimization with regards to the amount of the steam that is to be introduced into the gap for a proper and controlled heating of the pipe section.

According to a further preferred embodiment, the wall portion extends obliquely out from the inlet end of the liner pipe section towards the internal wall surface of the pipe section and is widening in the direction towards the inlet end of the pipe section.

With such an oblique extension of the wall portion, the flow of steam into the liner pipe section will have the speed increase in the area where the water is injected. This makes the heat transfer from the water droplets to the steam more efficient.

According to a further preferred embodiment, the angle of the wall portion with the axial direction of the liner pipe section is in the range between 15 and 45°.

The nozzles of the water injection means preferably are located close to the inlet end of the liner pipe section. With an angle within this range, the speed increase of the steam flow will be optimal with regard to an appropriate location of the water injection in that area. Normally the oblique direction follows a straight line, i.e. the wall portion is conical if the liner pipe section is cylindrical, which normally is the case. The oblique direction in some cases may follow a curved line, e.g. a parabolic line. In that case the mentioned angle relates to the mean angle of the curved line corresponding to the direction of a line from the contact zone to the location where the wall portion joins the axially directed part of the liner pipe section.

According to a further preferred embodiment, the liner pipe section is attached to the pipe section by a clamp connection means adjacent the outlet end of the liner pipe section which clamp connection means is fastened to the interior wall surface of the pipe section and has an inner surface that abuts the external wall surface of the liner pipe section. It is foreseen that this new attachment principle may be of use independent of how the front end of the liner is designed. Hence, a separate protection may be applied for e.g. by means of a divisional application.

Providing the attachment of the liner pipe section at the outlet end has the advantage that the temperature difference between the liner pipe section and the pipe section here is at minimum. This leads to less stresses at the fastening location on the pipe section in comparison with a fastening more close to the inlet end such as adjacent this end. The fastening may be by a weld. Using a clamp connection means between the liner pipe section and the pipe section results in a more robust and secure connection than otherwise.

According to a further preferred embodiment, the clamp connection means includes at least one axially directed opening establishing communication between the two axial sides of the clamp connection means.

With one or more openings in the clamp connection means it will be possible for the steam fraction that at the inlet end flows into the gap between the pipe sections to escape therefrom, and at the outlet join with the main steam flow. For a sufficient heating of the pipe section by the steam, it is of course advantageous to provide for an outflow of the steam from the gap. Arranging such an outflow according to this embodiment avoids waste of steam to the exterior.

According to a further preferred embodiment, the clamp connection means includes at least two units separated in the circumferential direction by a circumferential gap at each circumferential end of the units, which gaps form said at least one axially extending opening.

Splitting the clamp connection means into a plurality of parts, in particular two parts, in this way facilitates mounting of the liner pipe section to the clamp connection means. And the circumferential gap(s) thereby is/are formed in a simple way.

According to a further preferred embodiment, the exterior wall surface of the liner pipe section and the inner surface of the clamp connection means are shaped to provide axial locking relative each other.

Thereby the liner pipe section will be axially fixed in an advantageous way. Any increase of the length of the liner pipe section in relation to the pipe section due to temperature differences will be taken up at the inlet end where the contact zone is free to slide against the internal wall surface of the pipe section. Providing the axial locking by shape configuration leads to less stresses in comparison with other alternatives such as by strong squeezing.

According to a further preferred embodiment, the axial locking is formed by at least one outwardly extending projection of the external wall surface of the liner pipe section and a correspondingly shaped and located recess in the inner surface of the clamp connection means for each projection.

This is a simple way of obtaining the axial locking

According to a further preferred embodiment, there is only one projection formed as a circumferentially extending rim.

Such rim and corresponding groove are advantageous with regards to the manufacturing.

According to the second aspect of the invention, the object is achieved in that the invented attemperator, in particular according to any of the preferred embodiments thereof, is used for supplying steam to a machine, e.g. a turbine.

The invented use profits from advantages similar to those of the invented attemperator and the preferred embodiments thereof, respectively, which advantages have been described above.

The above described preferred embodiments of the invention are set out in the dependent claims. It is to be understood that further preferred embodiments may be constituted by any possible combination of features of the described preferred embodiments and by any possible combination of features in these with features described in the description of examples below.

DESCRIPTION OF EXAMPLE

Figure 1:
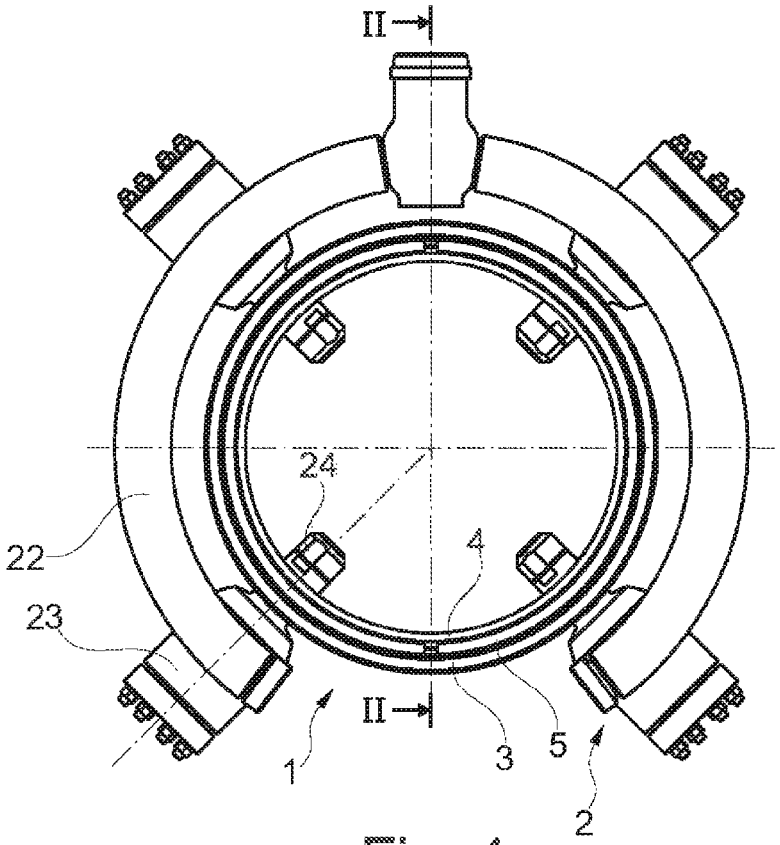
FIG. 1 is an end view of an attemperator according to the invention as seen from the outlet end.
Figure 2:
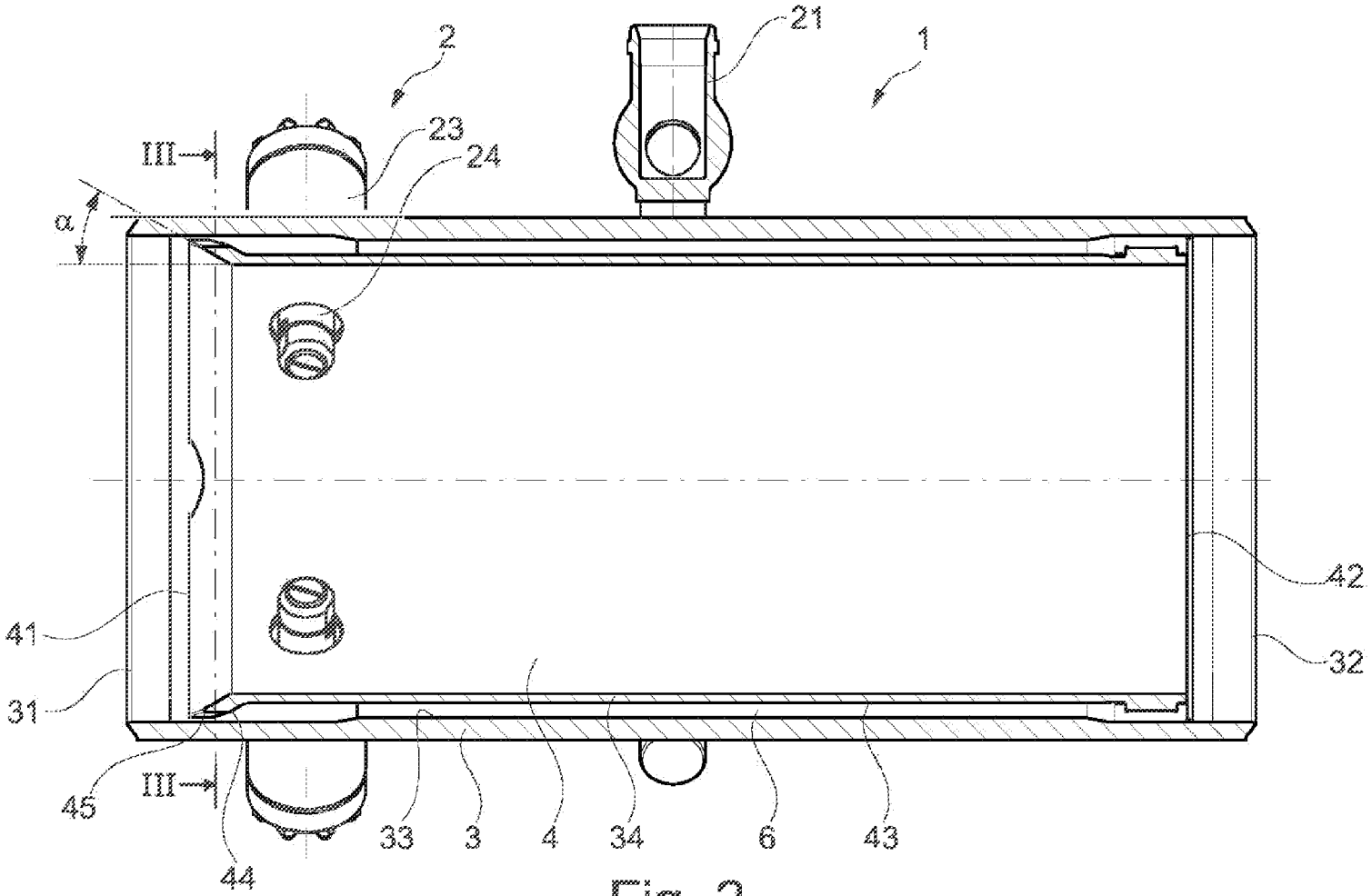
FIG. 2 is a section along line II-II of FIG. 1.

FIGS. 1 and 2 depict an attemperator according to an example of the present invention. The attemperator consist of an attemperator pipe section 1 and a water injection device 2. The attemperator has externally a pipe section 3. Inside the pipe section 3 is a liner pipe section 4. The pipe section 3 and the liner pipe section 4 in this example both are of circular shape and are coaxial. In operation the pipe section 2 is intended to be a part of a supply pipe for supplying superheated steam to a turbine.

The water injection device 2 is arranged to spray water into the attemperator pipe section 1 in order to cool the superheated steam flowing therethrough. The water injection device has an inlet 21 which is to be connected to a water supply. From the inlet 21 the water flows into a circumferential water pipe 22 that surrounds the attemperator pipe section 1.

The water is introduced into the interior of the liner pipe section 4 through a number of nozzles 24 extending through both the pipe section 3 and the liner pipe section 4. In the example the number of nozzles 24 is four, and they are evenly distributed in the circumferential direction. Each nozzle 24 is provided with an atomizer 23 for supplying the water as small droplets. The nozzles 24 are located axially adjacent the inlet end 41 of the liner pipe section 24.

An axially directed water distribution pipe (not shown in the figures) extends outside of the pipe section 3 from the circumferential water pipe 22 to each atomizer/nozzle 23/24.

The water is supplied from the inlet 21 via the circumferential pipe 22, the distribution pipes, the atomizers 23 and the nozzles 24 into the steam flowing through the liner pipe section 4 so that the steam is cooled.

The internal diameter of the pipe section 3 is larger than the external diameter of the lining pipe section 4. A gap 6 thus is formed by the internal wall surface 33 of the pipe section 3 and the external wall surface 43 of the liner pipe section 4. The gap is relatively small. For a tube pipe section 3 of about 700 mm diameter, the gap 6 should be in the order of 10 to 20 mm.

At its inlet end 41 the liner pipe section 4 has a conical portion 44, which conical portion extends outwardly along an angle $\alpha$ to the internal wall surface 33 of the pipe section 3 and to preferably contact therewith along a circumferential contact zone. The large end of the conical portion 44 is directed towards the inlet end 31 of the pipe section 3 and thus decreases in diameter in the steam flow direction. The conical portion is shown to form an angle $\alpha$ with the axis of the liner pipe section that is about 30°, preferably within 20°-40°.

Figure 3:
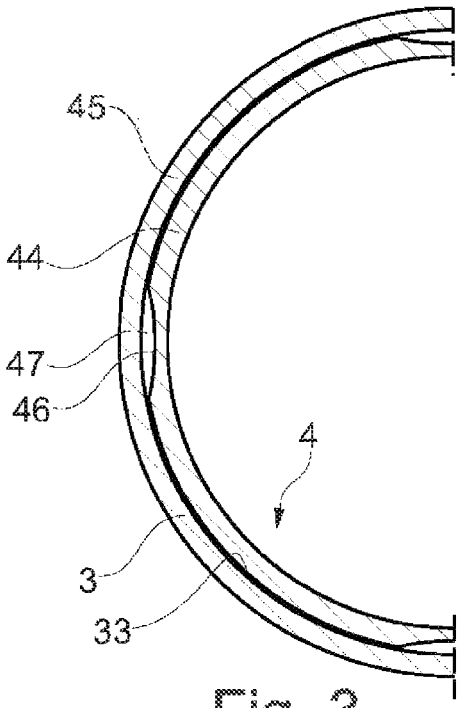
FIG. 3 is a section along line of FIG. 2 but with some details left out.

Referring now to FIG. 3 which is a partial section along line III-III of FIG. 2, it can be seen that the conical portion 44 may be in contact with the interior wall surface 33 of the pipe section 3 along a circumferential outer zone 45. At four equally distributed locations along the outer zone 45, the possible contact zone is broken by a recess 46 in the conical portion 44. Thereby forming a small opening 47 between the recess 45 and the internal wall surface 33 of the pipe section 3. When the inlet end 31 of the pipe section 3 is connected to a pipe supplying superheated steam most of the steam will flow through the interior of the liner pipe section 4 where it mixes with the injected water before reaching the outlet end 32 of the pipe section 3. A small fraction of the steam, however will flow through the openings 47 into the gap 6 between the pipe sections 3, 4. The steam thereby will heat the pipe section 3 somewhat.

The openings may alternatively be obtained by making recesses in the internal wall surface 33 of the pipe section, in the area where this surface may contact the outer zone 45. A further alternative is to obtain the openings by borings through the conical portion 44. Within the scope of invention, the number of openings may of course be other than four, and the circumferential extensions of the openings as well as their through flow areas may also vary. It is also to be understood that the conical portion 44 may be a wall portion having a shape deviating from that of a cone, and also that alternatively to positioning the front end 41 by means of contact of the outer zone 45, it may be achieved by the nozzle devices 24.

Figure 4:
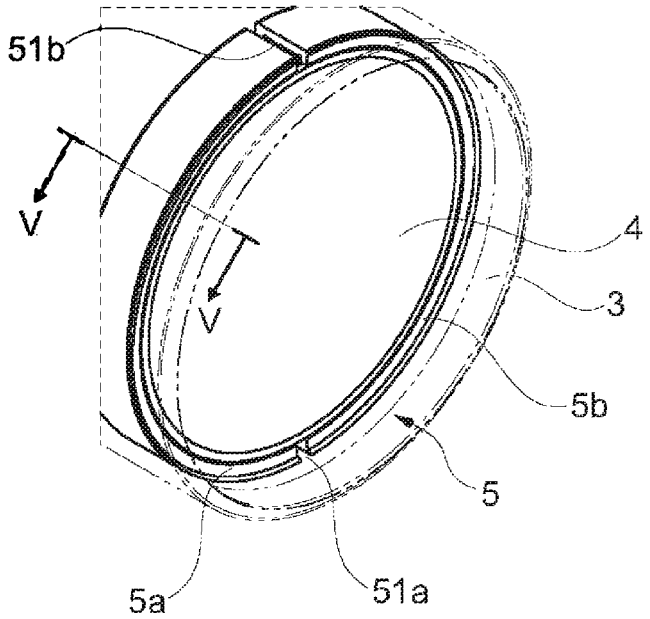
FIG. 4 is a perspective view of the inlet end of the liner pipe section of the attemperator of FIGS. 1-3.

FIG. 4 illustrates the attachment of the liner tube section 4 to the tube section 3. This connection is arranged adjacent the outlet end 42 of the liner tube section. A clamp connection means 5 is welded to the internal wall surface 33 of the pipe section 3 and is clamped around the liner pipe section 4. The clamp connection means 5 in this example consists of two separate units 5*a*, 5*b*. At both locations where the units 5*a*, 5*b* meet each other, a small circumferential clearance is formed whereby an opening 51*a*, 51*b* is established in the axial direction. At least one of these opening extends into the gap 6 and thereby allows the steam which has entered the gap to escape from the gap at the outlet end of liner pipe section 4. Preferably both of said openings 51*a*, 51*b* extend into the gap to provide two flow paths for the steam in the gap. Thus, there is provided at least one opening 51*a*, 51*b* at the outlet end 42 of the liner pipe section 4 arranged to allow steam to exit the space formed by the gap (6) between said internal wall surface 33 and said external wall surface 43 and enter the pipe section 3 at the end of the liner pipe section 4. Additional openings may be provided to provide redundancy in the event of an opening becoming blocked and/or to achieve a desired flow rate. While the opening(s) may conveniently be made by providing the small circumferential clearance where the units 5*a*, 5*b* meet as described above, it is possible to make openings that extend substantially in the axial direction from the gap in other ways, for example by bore holes or grooves or the like in the clamp connection means or one or more of the internal or external wall surfaces.

Figure 5:
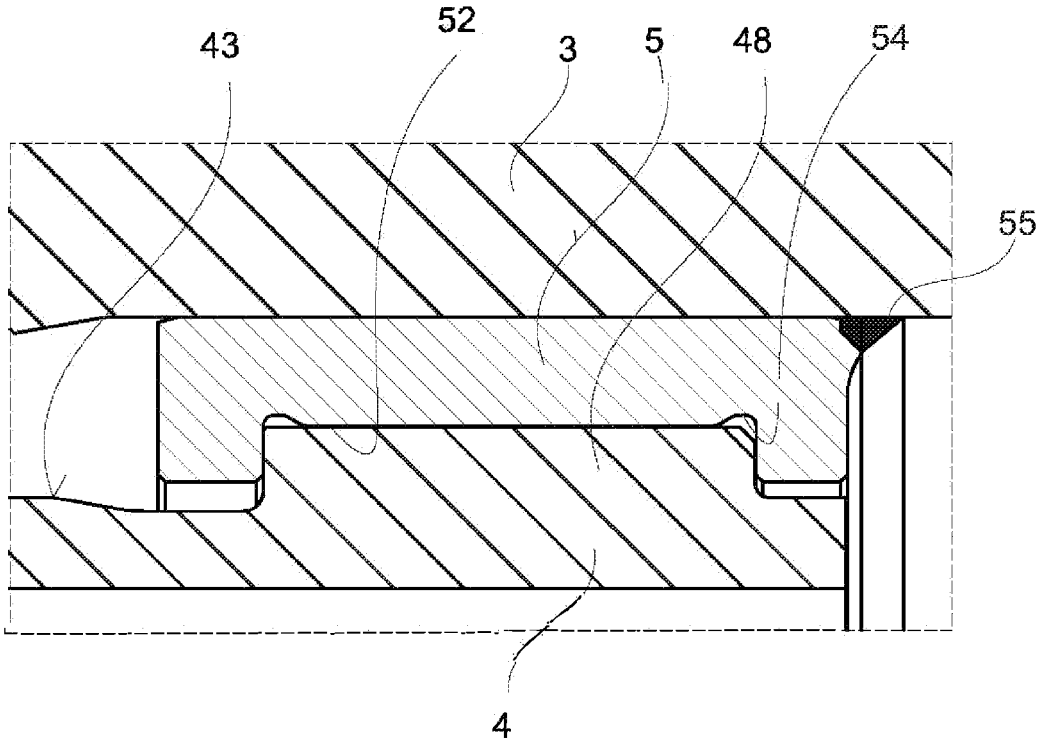
FIG. 5 is a section along line V-V of FIG. 4.

FIG. 5 is an enlarged section through the clamp connection means 5 and adjacent elements. The exterior wall surface 43 of the liner pipe section 4 is provided with a radially extending projection 48. The projection 48 may be a rim extending along the complete circumferential. The inside of the clamp connection means has a recess 52 of corresponding shape such that the projection 48 projects into the recess 52 and thereby provides axial locking of the liner pipe section 4.

The invention is not limited by the examples described above but may be varied within the scope of the appended claims. For instance it may be used a different clamp connection means 5 in the form of rotatable connecting members, e.g. having the liner pipe section 4 arranged with a plurality of rim portions, symmetrically displaced along the inner periphery with corresponding gaps them between and the pipe section 3 having a corresponding arrangement, enabling interfit by means of first axially introducing the liner pipe section 4 into the pipe section 3, wherein the gaps and rim portions allow the pipe sections to be moved for interfit. Thereafter the liner pipe section 4 may be rotated whereby the rim portions enter into the recess within the rim portions of the pipe section, according to the bayonet connecting principle.

The invention claimed is:

1. An attemperator including a pipe section (3) and a liner pipe section (4) arranged within the pipe section (3) and being attached thereto, the pipe section (3) having an internal wall surface (33) and the liner pipe section (4) having an external wall surface (43), which internal wall surface (33) and external wall surface (43) form a gap (6) between them along at least a major part of the axial extension of the liner pipe section (4), which pipe section (3) and liner pipe section (4) each has an inlet end (31, 41) for connection to a steam supply and an outlet end (32, 42) for steam, and which attemperator is provided with water injection means (2) arranged for supplying water into the interior of the liner pipe section (4), the inlet end (41) of the liner pipe section (4) having an outwardly extending wall portion (44) forming an outer circumferential zone (45), which zone (45) is adjacent or in contacts with the internal wall surface (33) of the pipe section (3) wherein there is provided at least one opening (47) at the inlet end (41) of the liner pipe section (4) arranged to allow steam to enter the space formed by the gap (6) between said internal wall surface (33) and said external wall surface (43), wherein the at least one opening (47) is a plurality of openings, and wherein the liner pipe section (4) is attached to the pipe section (3) by a clamp connection means (5) adjacent the outlet end (42) of the liner pipe section (4) which clamp connection means (5) is fastened to the interior wall surface (33) of the pipe section (3) and has an inner surface (52) that abuts the external wall (43) of the liner pipe section (4).

2. An attemperator according to claim 1, wherein the openings (47) are evenly distributed in the circumferential direction.

3. An attemperator according to claim 1 wherein each opening (47) is formed between said internal wall surface (33) and a recess (46) in said contact zone (45).

4. An attemperator according to claim 1, wherein the total circumferential extension of the least one opening (47) is in the range of 5 to 20% of the circumferential length of the contact zone.

5. An attemperator according to claim 1, wherein the total through flow area of the least one opening (47) is in the range of 1 to 10% of the total cross area of said space in a section perpendicular to the axial extension of the pipe section.

6. An attemperator according to claim 1, wherein there is provided at least one axially extending opening (51*a*, 51*b*) at the outlet end (42) of the liner pipe section (4) arranged to allow steam to exit the space formed by the gap (6) between said internal wall surface (33) and said external wall surface (43).

7. An attemperator according to claim 1, wherein said wall portion (44) extends obliquely out from the inlet end (41) of the liner pipe section (4) towards the internal wall surface (33) of the pipe section (3) and is widening in the direction to the inlet end (31) of the pipe section (3).

8. An attemperator according to claim 7, wherein the angle (a) of said wall portion (44) with the axial direction of the liner pipe section (4) is in the range between 15 and 45°.

9. An attemperator according to claim 1, wherein the clamp connection means (5) includes at least one said opening (51*a*, 51*b*) establishing communication between the two axial sides of the clamp connection means (5).

10. An attemperator according to claim 1, wherein the clamp connection means (5) includes at least two units (5*a*, 5*b*) separated in the circumferential direction by a circumferential gap at each circumferential end of the units (5*a*, 5*b*), which circumferential gaps form said at least one said opening (51*a*, 51*b*).

11. An attemperator according to claim 1, wherein the exterior wall surface (43) of the liner pipe section (4) and the inner surface (52) of the clamp connection means (5) are shaped to provide axial locking relative each other.

12. An attemperator according to claim 11, wherein the axial locking is formed by at least one outwardly extending projection (48) of the external wall surface (43) of the liner pipe section (4) and a correspondingly shaped and located recess (52) in the inner surface of the clamp connection means (5) for each projection.

13. An attemperator according to claim 12, wherein there is only one projection (48) formed as a circumferentially extending rim.

14. A method of supplying steam at a controlled temperature to a turbine with an attemperator according to claim 1.

15. An attemperator according to claim 1 wherein the clamp connection means 5 is in the form of rotatable connecting members, wherein the liner pipe section 4 is arranged with a plurality of rim portions, symmetrically displaced along the inner periphery with corresponding gaps them between, and the pipe section 3 is provided with a corresponding arrangement, wherein the gaps and rim portions are arranged to allow the inner pipe section to be moved axially for fitting the inner pipe section within said clamp connections and thereafter the liner pipe section 4 may be rotated whereby the rim portions enter into the recess within the rim portions of the pipe section to from a bayonet connection.

16. An attemperator according to claim 7, wherein the angle (a) of said wall portion (44) with the axial direction of the liner pipe section (4) is in the range between 25 and 35°.

* * * * *